United States Patent [19]

Bolt et al.

[11] 4,434,804

[45] Mar. 6, 1984

[54] SMOKING ARTICLE

[75] Inventors: Anthony J. N. Bolt; Brian C. Chard, both of Bristol, England

[73] Assignee: Imperial Group Limited, Bristol, England

[21] Appl. No.: 271,986

[22] Filed: Jun. 9, 1981

[30] Foreign Application Priority Data

Jun. 21, 1980 [GB] United Kingdom ..... 8020405

[51] Int. Cl.[3] ..... A24B 3/12

[52] U.S. Cl. ..... 131/309; 131/300; 131/310; 131/363; 131/364; 131/31; 131/62

[58] Field of Search ..... 131/309, 310, 300, 364, 131/361, 362, 363, 366, 347, 290, 274, 337, 62, 31

[56] References Cited

U.S. PATENT DOCUMENTS

| | | | |
|---|---|---|---|
| 1,749,582 | 3/1930 | Hopkins | 131/300 |
| 1,796,522 | 3/1931 | Hopkins | 131/364 |
| 3,550,598 | 12/1970 | McGlumphy | 131/337 |
| 3,759,267 | 9/1973 | Thornton | 131/364 |

*Primary Examiner*—Vincent Millin

*Attorney, Agent, or Firm*—Larson and Taylor

[57] ABSTRACT

Smoking articles, e.g. cigarettes, are disclosed into the fuel rod of which particulate smoke-modifying agent has been introduced in such a manner that the concentration of the agent is greater at one or each end of the fuel rod than that at the middle region of the fuel rod. The result of this variation in concentration of the smoke-modifying agent is that the amount of agent released into the smoke varies as the article is smoked. Various forms of smoking article are disclosed together with methods of production.

6 Claims, 9 Drawing Figures

Fig.1.
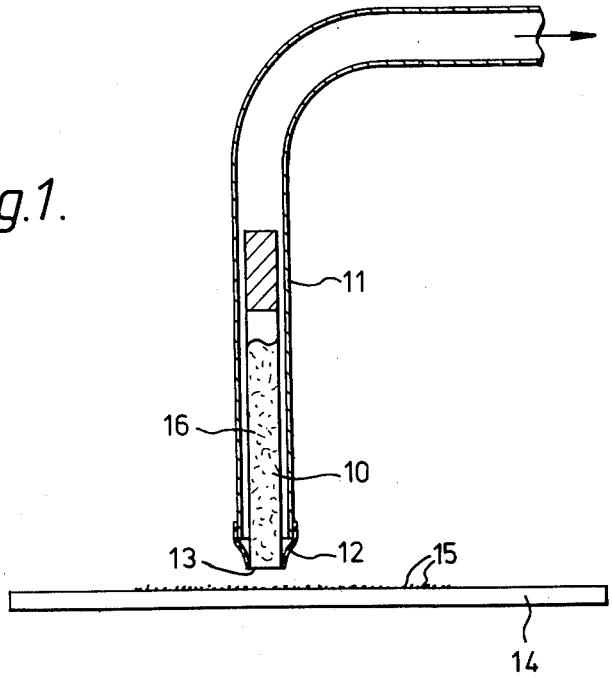
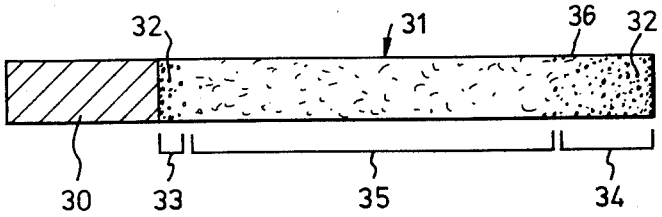
Fig.3.
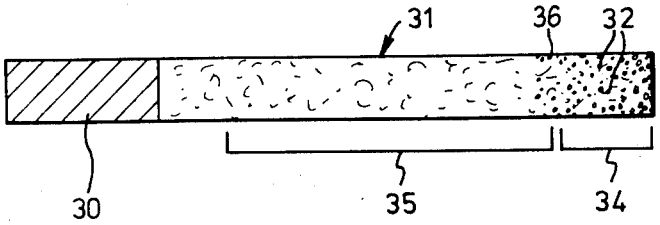
Fig.4.

SMOKING ARTICLE

TECHNICAL FIELD

In various types of smoking article it is desirable to include in the fuel material a flavourant or other smoke modifying agent. In use the agent becomes entrained in the smoke prior to its inhalation by the smoker. An example is the inclusion in a low tar cigarette of additional nicotine and flavour.

BACKGROUND ART

One previously proposed method of flavouring a conventional smoking article such as a cigarette was to spray the tobacco rag with liquid flavourant prior to manufacture of the cigarette. This method was unsatisfactory as the flavourant tended to migrate throughout and away from the cigarette. The spraying of the flavourant led to contamination of the production machinery and also of the waste offals and fines making them unsuitable for reprocessing. Also volatile materials in the tobacco tended to be lost by evaporation during the production process.

Another previously proposed method of providing a cigarette with additional flavour is described in U.S. Pat. No. 3,006,347 in the name of R. J. Reynolds. In this patent streaks of flavour impregnated starch paste were applied to the wrapper which was wrapped around the tobacco rod. This method undesirably altered the physical properties and the appearance of the cigarette paper. Also the capacity of the cigarette paper to take flavour additives is far less than that of the tobacco in the fuel rod.

It has also been proposed to add flavour to the filter element of a conventional cogarette. The drawback of this technique was that the location of the flavour was so remote from the burning coal that the less volatile component of the flavour only reached a noticeable concentration in the smoke in the later puffs during smoking.

INVENTION

According to a first aspect of the invention we provide a smoking article comprising a fuel rod having a light-up end and an opposite end and a quantity of particulate smoke-modifying agent located in the fuel rod, wherein the concentration of the agent in the fuel rod is greater at the region of the light-up end than at the region between the two end regions.

According to a second aspect of the invention we provide for a smoking article comprising a fuel rod having a light-up end and an opposite end, a method of introducing a quantity of particulate smoke-modifying agent into the fuel rod, the method comprising causing a stream of air to pass through the fuel rod from the light-up end to the opposite end, causing the smoke modifying agent to become entrained in the stream of air to form a particle cloud and causing it to enter and pass along the fuel rod.

DRAWINGS

Figure 2:
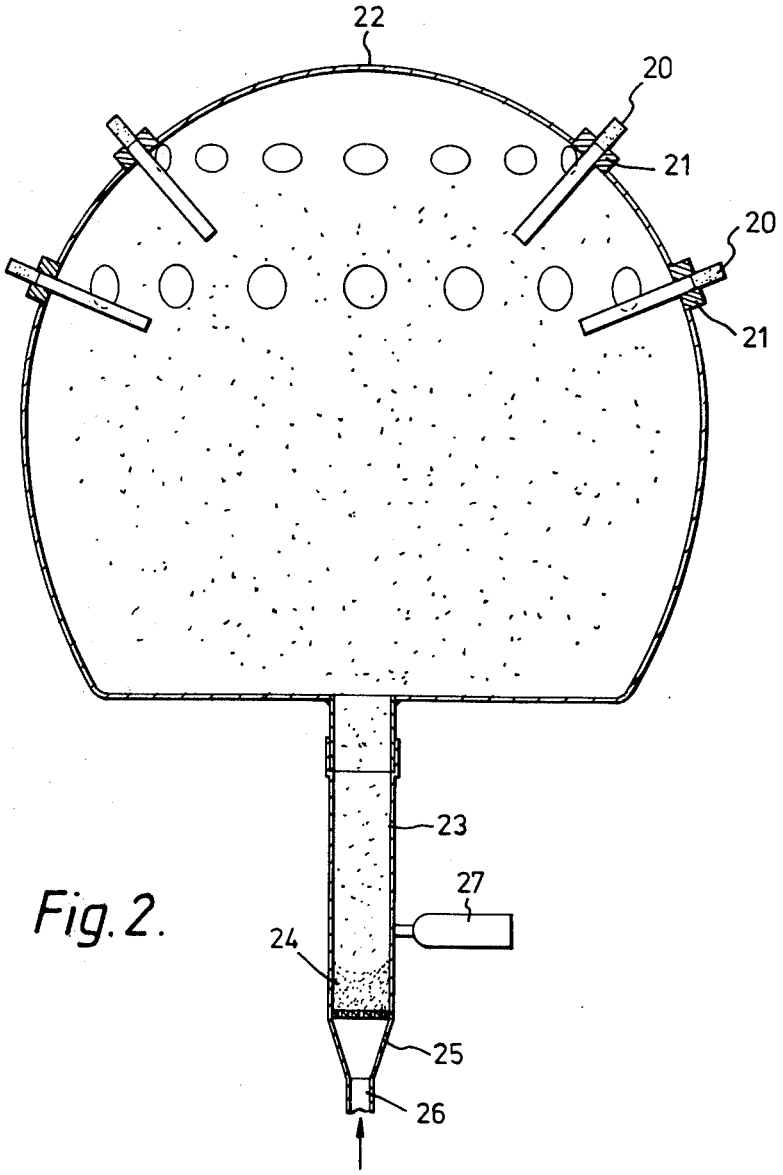
Figure 5:
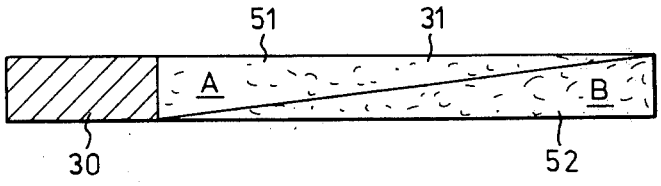
Figure 6:
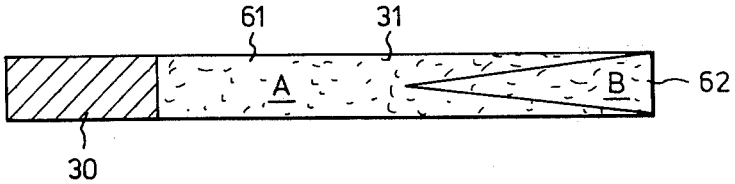
Figure 7:
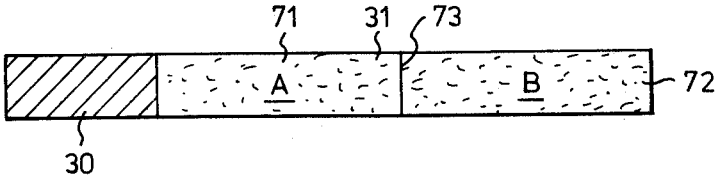
Figure 8A:
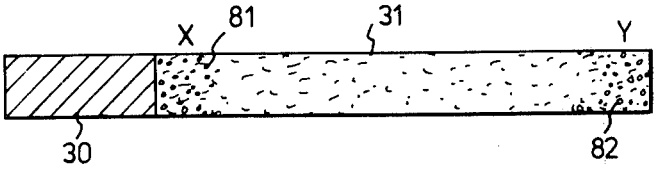
Figure 8B:
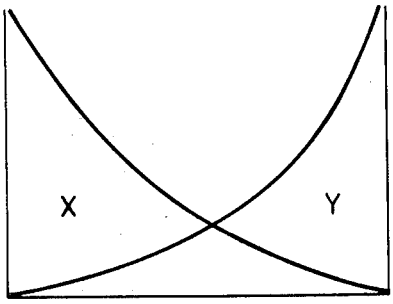

The invention will now be described by way of example only with reference to the accompanying diagrammatic drawings of which:

FIG. 1 is a schematic section through an apparatus for introducing a quantity of smoke-modifying material into a cigarette by suction, FIG. 2 is a schematic section through an apparatus for introducing a quantity of smoke-modifying material into a cigarette by blowing air therethrough, FIGS. 3 and 4 are each a section through a cigarette after having smoke-modifying material introduced into it, FIGS. 5, 6 and 7 are each a section through a cigarette formed of two different materials, FIG. 8*a* is a section through a cigarette after having smoke modifying material introduced into it from each end, and FIG. 8*b* is a graph of the distribution of the smoke modifying material in the cigarette of FIG. 8*a*.

In FIG. 1 a previously produced filter cigarette 10 is located within a tube 11 whose internal diameter is slightly more than the external diameter of the cigarette. An air-tight seal between the cigarette 10 and the tube 11 is provided by a flexible rubber sleeve 12 which fits closely around both tube and cigarette. The end of the tube 11 remote from the cigarette is connected to a suction pump (not shown).

The end 13 of the cigarette 10 which projects from the sleeve 12 is located at a distance of approx. 1 mm from a planar surface 14. On to the surface 14 is sieved a quantity of spray-dried flavour 15 of a particle size within the range 3–25 micron. The weight of flavour per unit area of the surface 14 is previously determined during sieving. Having prepared the flavour the vacuum pump is switched on and the end 13 of the cigarette is gradually moved across a pre-determined area of the surface 14. During this movement air drawn into the cigarette entrains the particulate flavour on the surface 14 and causes it to enter and pass along the fuel rod 16 of the cigarette 10. The vacuum pump is arranged to draw in air in pulses so that an intermittent stream of air is drawn through the cigarette. This aids the dispersion of the entrained particulate material through the cigarette. A known weight of material is thus drawn into the cigarette. The completed cigarette is finally removed from the tube 11.

In the apparatus of FIG. 2 a number of previously made filter cigarettes 20 are loaded into cylindrical holders 21 located around an array of holes formed in the wall of a closed dome 22. A flexible sleeve (not shown) is located in each holder 21 to provide an air-tight seal with the outer surface of the cigarette 20. The interior of the dome 22 connects with detachable inlet pipe 23. The pipe 23 contains a quantity of particulate spray-dried material 24 of particle size in the range 3–25 micron. The material 24 is supported on a perforated disc 25 at the inlet end 26 of the pipe 23. In use air is blown in intermittent pulses into the inlet end 26 of the pipe 23 and passes through the material 24. A vibrator unit 27 attached to the pipe 23 assists in the entrainment of the particulate material in the air stream. The entrainment material 24 is carried by the air up pipe 23 to form a particle cloud inside the dome 22. The particle cloud is blown in pulses equally through each of the cigarettes 20 previously located in position on the dome. On passing axially through each cigarette from its light-up end 28 the airflow causes the material particles in the particle cloud to enter and pass along the cigarette and be deposited therein. The air supply is applied to the inlet pipe 23 for a measured time in order to introduce a pre-determined quantity of particulate material into each cigarette 20. The treated cigarettes 20 are then removed from the holders 21 and any excess material clinging to the ends 28 or the external surface is removed by an air jet.

In FIG. 3 a treated cigarette has a filter tip 30 and a tobacco fuel rod 31. In the fuel rod 31 are particles of smoke-modifying material 32. The manufacturing process in this example produces cigarettes in which the tobacco density is greater at the end regions 33, 34 than in the middle region 35. This variation in the tobacco density may be utilised to promote further the gradients in the concentration of deposited material. Thus there tends to be a greater concentration of material in the end regions 33, 34 compared to the middle region than would otherwise be so in a constant density cigarette. Channelling of the material occurs through lines of least resistance in the tobacco. Also greater deposition of the material occurs at the periphery than at the central axis due to channels existing between a paper wrapper 36 and the tobacco in contact with it. Again this is an unexpected but desirable effect in view of a cigarette's greater propensity for peripheral rather than for axial burn during puffing.

FIG. 4 shows a section through a treated cigarette into which larger particles within the range 3–25 microns have been introduced in pulses of short duration. The introduction time is shorter than that used to introduce particles in the arrangement shown in FIG. 3. This shorter introduction time combined with the lesser penetration of the larger particles produces only a gradient of particle deposition at the light-up end of the cigarette. Selecting the velocity of the airflow through the cigarette assists the formation of the desired gradient of particle deposition. This gradient is beneficial during the initial few puffs after lighting the cigarette. With, for example, a normal low tar cigarette there is a deficiency of nicotine and flavour during the initial puffs. The greater concentration of flavourant material in the end region 34 compensates for the initial lack of such flavour. As the cigarette is smoked the natural flavour develops to compensate for the decreased concentration of the added flavour material in the middle region 35. The same applies to nicotine and other smoke modifying agents.

FIGS. 5, 6 and 7 are each a section through a cigarette formed of two different types of smokeable material. In each case either or both smokeable materials contains its respective smoke-modifying agent.

In the cigarette of FIG. 5 the fuel rod comprises two equal parts, 51 and 52, each of a respective type of smokeable material. Either material A or material B or both may contain its respective smoke-modifying agent. For example, material A may contain a smoke cooling agent such as menthol to counteract the over strong flavour which may occur during the final puffs of the cigarette. As the fuel rod burns the proportion of material A at the burning coal increases and hence the proportion of the respective smoke modifying agent released into the smoke increases also. Material B may contain a mixture of a smoke flavour, or a tobacco flavour enhancer and nicotine to boost the flavour of the smoke in the early puffs. As the proportion of material B decreases as the fuel rod is consumed, so the amount of flavour released into the smoke decreases also. Less flavour enhancement is required in later puffs as the natural flavour tends to build up as the cigarette is smoked.

The cigarette of FIG. 6 comprises a conical form 62 of material B contained within the fuel rod 61 of material A. This form provides a second method of progressively increasing and decreasing the proportions of materials A and B respectively while the cigarette is smoked and hence of increasing or decreasing the proportions of the respective smoke modifying agents. Alternatively the filter 30 may be applied at the opposite end of the rod.

In FIG. 7 the cigarette comprises two different smokeable materials 71, 72 which meet at some point along the length of the article at a cross-sectional interface 73. Thus there is an abrupt change between the two types of smoking material as opposed to the gradual change which occurs in the cigarettes of FIGS. 5 and 6.

Changes in the concentration of two types of particulate smoke-modifying agent in opposite directions along the longitudinal axis of the fuel rod may alternatively be achieved by introducing the agents sequentially into each end of an untipped cigarette prior to the attachment of the filter tips. The introduction of the agents may be made by either of the methods shown in FIG. 1 or 2. The result of this method of sequential introduction is shown in FIG. 8A which shows the two regions 81 and 82 of smoke-modifying agents X and Y respectively. FIG. 8B shows a graph of the concentration gradients of agents X and Y along the length of the fuel rod.

In order that the smoke-modifying agent or material is not visible through the paper 36 it may be dyed a similar colour to that of tobacco.

It is envisaged that the smoke-modifying material may be a flavour such as wood-smoke, liquorice, menthol or coffee. Alternatively the material may be nicotine or a derivative thereof. Synthetic flavours may also be used. In each case the flavourant may be microencapsulated by spray drying in gum acacia, modified starch or in gelatine or a mixture thereof or another carrier. Such microencapsulation gives ease of handling and minimal deterioration of the smoke-modifying agent during storage, also the loss by evaporation of the volatile substances is markedly reduced.

The use of microencapsulation also is beneficial in that release of the agent is delayed until the cigarette is smoked.

The application of the smoke-modifying agent to a finished cigarette avoids contamination of the cigarette production machinery and of offals and fines resulting from the manufacturing process. As a result such uncontaminated offal and fines may be freely re-used. Also the problem of 'spotting' on the cigarette paper which occurred when using liquid flavourants does not occur when using particulate smoke-modifying agent.

It is envisaged that other gases apart from air, e.g. Nitrogen may be used to form the cloud of particulate smoke-modifying agent.

The invention as described above is also suitable for use with cigars or smoking articles containing tobacco substitute material.

It is envisaged that a cigarette might contain of the order of 1 mg of encapsulated smoke modifying agent for each 65 mg of the fuel rod.

We claim:

1. A method of introducing a quantity of solid particulate flavor material having a particle size in the range 3–25 micron into the tobacco rod of a ready-made cigarette or cigar, the method comprising entraining the particulate material in a stream of air to form a cloud of the particulate material, and causing the cloud of particles to enter and pass along the tobacco rod from the light-up end to the mouth end so as to provide a concentration of particulate material in the tobacco rod that is greater at either end of said rod than between its ends.

2. A method as claimed in claim 1 wherein the particulate material is in micro-encapsulated spray dried form.

3. A method as claimed in claim 1 wherein the concentration of the particulate material in the tobacco rod is about 1 mg of microcapsules for each 65 mg of the fuel rod.

4. A method as claimed in claim 1 wherein the cloud of particles is caused to pass through the fuel rod in pulses of short duration.

5. A method as claimed in claim 1 wherein the air is drawn through the fuel rod from the end opposite the light-up end.

6. A method as claimed in claim 1 wherein the air is blown through the fuel rod from the light-up end.

* * * * *